US012114741B2

(12) United States Patent
Yang et al.

(10) Patent No.: US 12,114,741 B2
(45) Date of Patent: Oct. 15, 2024

(54) ZIPPER STRUCTURE AND RELATED ZIPPER BAG

(71) Applicant: Universal Trim Supply Co., Ltd., New Taipei (TW)

(72) Inventors: Shih-Sheng Yang, Taipei (TW); Chia-Hsin Wu, Taoyuan (TW)

(73) Assignee: Universal Trim Supply Co., Ltd., New Taipei (TW)

( * ) Notice: Subject to any disclaimer, the term of this patent is extended or adjusted under 35 U.S.C. 154(b) by 295 days.

(21) Appl. No.: 17/863,373

(22) Filed: Jul. 12, 2022

(65) Prior Publication Data

US 2023/0371658 A1 Nov. 23, 2023

(30) Foreign Application Priority Data

May 17, 2022 (CN) ..... 202210535700.5

(51) Int. Cl.
*A44B 19/14* (2006.01)
*A44B 19/26* (2006.01)

(52) U.S. Cl.
CPC ..... *A44B 19/14* (2013.01); *A44B 19/26* (2013.01)

(58) Field of Classification Search
CPC ..... A44B 19/14; A44B 19/26; B31B 70/64; B31B 70/8131; B31B 2160/102; B65D 33/2508
See application file for complete search history.

(56) References Cited

U.S. PATENT DOCUMENTS 2,674,289 A * 4/1954 Silverman ..... B65D 33/25 383/61.3
2,746,502 A * 5/1956 Graell ..... B65D 33/2508 383/65
5,161,286 A * 11/1992 Herrington, Jr. .... B65D 33/259 24/387
5,836,056 A * 11/1998 Porchia ..... B65D 33/2541 24/399
6,928,702 B1 * 8/2005 Savicki ..... B65D 33/25865 24/30.5 R
7,040,808 B2 * 5/2006 Rehwinkel ..... B65D 33/2508 383/203
8,690,430 B2 * 4/2014 Burggren ..... A44B 19/14 24/399
10,065,770 B2 * 9/2018 Howell ..... B65D 5/064
(Continued)

*Primary Examiner* — Robert Sandy
*Assistant Examiner* — Louis A Mercado
(74) *Attorney, Agent, or Firm* — Winston Hsu

(57) ABSTRACT

A zipper structure is provided and includes a first zipper component including a first zipper portion, a second zipper component including a second zipper portion, and a sealing end assembly. An end part of the first zipper portion of the first zipper component adjacent to an end of the first zipper component and an end part of the second zipper portion of the second zipper component adjacent to an end of the second zipper component are engaged with each other. The sealing end assembly is connected to the ends of the first zipper component and the second zipper component by injection molding and covers surfaces of the ends of the first zipper component and the second zipper component. A gap between the end parts of the first zipper portion and the second zipper portion is filled with the sealing end assembly. Furthermore, a related zipper bag is also provided.

15 Claims, 10 Drawing Sheets

(56) References Cited

U.S. PATENT DOCUMENTS

| | | | | |
|---|---|---|---|---|
| 11,772,849 | B2 * | 10/2023 | DeCarlo | B65D 33/2508 383/63 |
| 2007/0177827 | A1 * | 8/2007 | Tilman | B65D 33/2508 24/399 |
| 2014/0216969 | A1 * | 8/2014 | Cherian | B65D 33/007 383/105 |
| 2018/0042368 | A1 * | 2/2018 | Mayer | A61B 5/0205 |
| 2023/0371658 | A1 * | 11/2023 | Yang | A44B 19/26 |

* cited by examiner

ZIPPER STRUCTURE AND RELATED ZIPPER BAG

BACKGROUND OF THE INVENTION

1. Field of the Invention

The present invention relates a zipper structure and a related zipper bag, and more specifically, to a zipper structure having improved sealing performance and a related zipper bag.

2. Description of the Prior Art

A zipper bag including a zipper structure can be open or closed by operating the zipper structure. Please refer to FIG. 1 and FIG. 2. FIG. 1 is a diagram of a zipper structure 1' in the prior art. FIG. 2 is a lateral view diagram of the zipper structure 1' from a viewing direction L1 in the prior art. As shown in FIG. 1 and FIG. 2, the zipper structure 1' can be disposed on a bag body, which is not shown in the figures, and includes a first zipper component 10*a*' and a second zipper component 10*b*' capable of being detachably engaged with or separated from each other repeatedly. The first zipper component 10*a*' includes a first zipper portion 100*a*'. The second zipper component 10*b*' includes a second zipper portion 100*b*'. The first zipper portions 100*a*' and the second zipper portion 100*b*' have matched shapes. The bag body includes two plate-shaped components. Border portions of the two plate-shaped components are connected to each other by plastic welding, so that the bag body is formed with a chamber and an opening communicated with the chamber. Conventionally, the zipper structure 1' is disposed away from the border portions of the two plate-shaped components and located between the two plate-shaped components. The first zipper component 10*a*' and second zipper component 10*b*' are connected to inner sides of the two plate-shaped components by plastic welding. Ends of the first zipper component 10*a*' and the second zipper component 10*b*' are not only connected to the inner sides of the two plate-shaped components but also connected to each other by plastic welding, so as to eliminate gaps i', I' between the ends of the first zipper component 10*a*' and the second zipper component 10*b*' for preventing leakage. Middle portions of the first zipper component 10*a*' and the second zipper component 10*b*' can be engaged with or separated from each other to close or open the opening.

However, sometimes, due to operational mistake of the plastic welding, a welding defect, such as a gap or a bubble, may be formed between the ends of the first zipper component 10*a*' and the second zipper component 10*b*', or between the plate-shaped component and one of the first zipper component 10*a*' and second zipper component 10*b*', which causes a negative impact on sealing performance. For example, please refer to FIG. 3 and FIG. 4. FIG. 3 is a grayscale photograph illustrating a welding portion of a bag body and an end of a zipper structure of a zipper bag in the prior art. FIG. 4 is an enlarged grayscale photograph of the welding portion shown in FIG. 3 in the prior art. As shown in FIG. 3 and FIG. 4, the welding portion of the bag body and the end of the zipper component are not completely connected to each other, and there is a hole formed on the bag body. Therefore, the zipper bag cannot be sealed properly.

Furthermore, applying additional plastic welding onto the welding portion of the bag body and the end of the zipper component may reduce formation of the gap or the bubble.

However, the aforementioned problem cannot be solved effectively by applying the additional plastic welding, and applying additional plastic welding may not only result in a hole formed on the bag body and/or deformation of the zipper structure easily but also affect aesthetic appearance.

SUMMARY OF THE INVENTION

Therefore, it is an objective of the present invention to provide a zipper structure and a related zipper bag for solving the aforementioned problem.

In order to achieve the aforementioned objective, the present invention discloses a zipper structure. The zipper structure includes a first zipper component, a second zipper component and a sealing end assembly. The first zipper component includes a first zipper portion. The second zipper component includes a second zipper portion. The first zipper portion and the second zipper portion have matched shapes for being detachably engaged with or separated from each other. An end part of the first zipper portion of the first zipper component adjacent to an end of the first zipper component and an end part of the second zipper portion of the second zipper component adjacent to an end of the second zipper component are engaged with each other. The sealing end assembly is connected to the end of the first zipper component and the end of the second zipper component by injection molding. The sealing end assembly includes two covering portions and a connecting portion. The two covering portions respectively cover a surface of the end of the first zipper component and a surface of the end of the second zipper component. The connecting portion is located between and connected to the two covering portions. A gap between the end part of the first zipper portion of the first zipper component adjacent to the end of the first zipper component and the end part of the second zipper portion of the second zipper component adjacent to the end of the second zipper component is filled with the connecting portion.

According to an embodiment of the present invention, the sealing end assembly further includes two bridge portions respectively outwardly extending from the two covering portions and away from the end of the first zipper component and the end of the second zipper component.

According to an embodiment of the present invention, two ends of each of the two bridge portions along a width direction respectively protrude beyond two extending lines of two sides of each of the first zipper component and the second zipper component along the width direction.

According to an embodiment of the present invention, an outer surface of the connecting portion is a concave surface and smoothly connected to two surfaces of the two bridge portions facing toward each other.

According to an embodiment of the present invention, two ends of each of the two bridge portions along a width direction respectively protrude beyond two extending lines of two sides of each of the first zipper component and the second zipper component along the width direction.

According to an embodiment of the present invention, the two bridge portions respectively extend along a plane where the first zipper component is located and a plane where the second zipper component is located.

According to an embodiment of the present invention, two ends of each of the two bridge portions along a width direction respectively protrude beyond two extending lines of two sides of each of the first zipper component and the second zipper component along the width direction.

In order to achieve the aforementioned objective the present invention further discloses a zipper bag. The zipper bag includes a bag body and a zipper structure. The bag body includes two plate-shaped components connected to each other by plastic welding. The bag body is formed with a chamber and an opening communicated with the chamber. The zipper structure is disposed on the bag body and located at a position corresponding to the opening. The zippering structure is located between the two plate-shaped components and includes a first zipper component and a second zipper component. The first zipper component includes a first zipper portion and is connected to an inner side of one of the two plate-shaped components by plastic welding. The second zipper component includes a second zipper portion and is connected to an inner side of another one of the two plate-shaped components by plastic welding. The first zipper portion and the second zipper portion have matched shapes for being detachably engaged with or separated from each other. An end part of the first zipper portion of the first zipper component adjacent to an end of the first zipper component and an end part of the second zipper portion of the second zipper component adjacent to an end of the second zipper component are engaged with each other. The sealing end assembly is connected to the end of the first zipper component and the end of the second zipper component by injection molding and located between the two plate-shaped components. The sealing end assembly covers a surface of the end of the first zipper component and a surface of the end of the second zipper component. A gap between the end part of the first zipper portion of the first zipper component adjacent to the end of the first zipper component and the end part of the second zipper portion of the second zipper component adjacent to the end of the second zipper component is filled with the sealing end assembly. The sealing end assembly is connected to the end of the first zipper component and the end of the second zipper component by injection molding, and after the sealing end assembly is connected to the end of the first zipper component and the end of the second zipper component by injection molding, the two plate-shaped components are respectively connected to the first zipper component and the second zipper component and are connected to each other and the sealing end assembly by plastic welding.

According to an embodiment of the present invention, a material of the bag body, a material of the first zipper component, a material of the second zipper component and a material of the sealing end assembly are identical.

According to an embodiment of the present invention, when the sealing end assembly is connected to the end of the first zipper component and the end of the second zipper component by injection molding. The sealing end assembly includes two covering portions, a connecting portion and two bridge portions. The two covering portions respectively cover the surface of the end of the first zipper component and the surface of the end of the second zipper component. The connecting portion is located between and connected to the two covering portions. The gap between the end part of the first zipper portion of the first zipper component adjacent to the end of the first zipper component and the end part of the second zipper portion of the second zipper component adjacent to the end of the second zipper component is filled with the connecting portion. The two bridge portions respectively outwardly extend from the two covering portions and away from the end of the first zipper component and the end of the second zipper component, and when the sealing end assembly is connected to the end of the first zipper component and the end of the second zipper component by injection molding, two surfaces of the sealing end assembly are respectively connected to the inner sides of the two plate-shaped components by plastic welding.

According to an embodiment of the present invention, a material of the bag body, a material of the first zipper component, a material of the second zipper component and a material of the sealing end assembly are identical.

According to an embodiment of the present invention, when the sealing end assembly is connected to the end of the first zipper component and the end of the second zipper component by injection molding, and an outer surface of the connecting portion is a concave surface and smoothly connected to two surfaces of the two bridge portions facing toward each other.

According to an embodiment of the present invention, a material of the bag body, a material of the first zipper component, a material of the second zipper component and a material of the sealing end assembly are identical.

According to an embodiment of the present invention, two ends of each of the two bridge portions along a width direction respectively protrude beyond two extending lines of two sides of each of the first zipper component and the second zipper component along the width direction.

According to an embodiment of the present invention, a material of the bag body, a material of the first zipper component, a material of the second zipper component and a material of the sealing end assembly are identical.

In summary, in the present invention, the sealing end assembly is connected to the end of the first zipper component and the end of the second zipper component by injection molding, so that the surface of the end of the first zipper component and the surface of the end of the second zipper component can be covered by the sealing end assembly, and the gap between the end part of the first zipper portion of the first zipper component adjacent to the end of the first zipper component and the end part of the second zipper portion of the second zipper component adjacent to the end of the second zipper component can be filled with the sealing end assembly. Therefore, the present invention has improved sealing performance.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "left", "right", "front", "back", etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive. Also, if not specified, the term "connect" is intended to mean either an indirect or direct mechanical connection. Thus, if a first device is connected to a second device, that connection may be through a direct mechanical connection, or through an indirect mechanical connection via other devices and connections.

Figure 7:
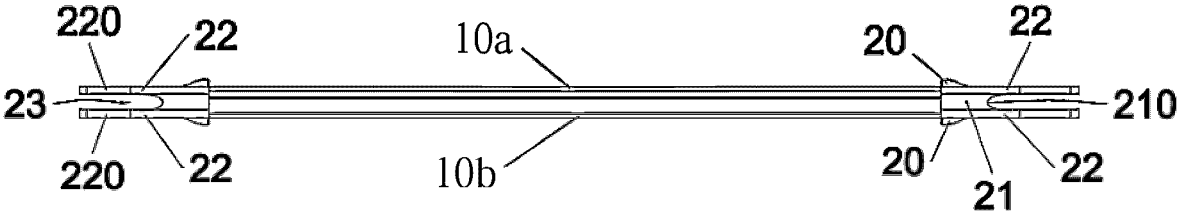
Figure 8:
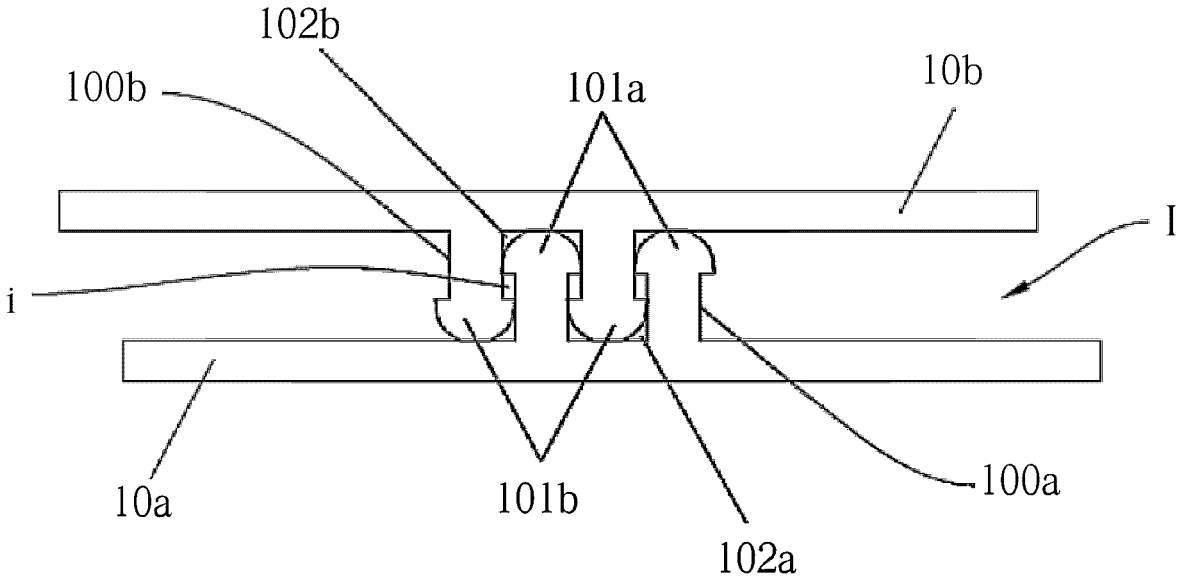
Figure 9:
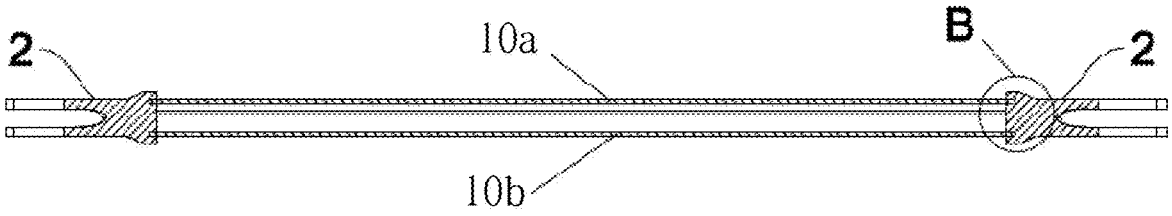
FIG. 9 is a sectional diagram of the zipper structure along an A-A line shown in FIG. 6 according to the first embodiment of the present invention.
Figure 10:
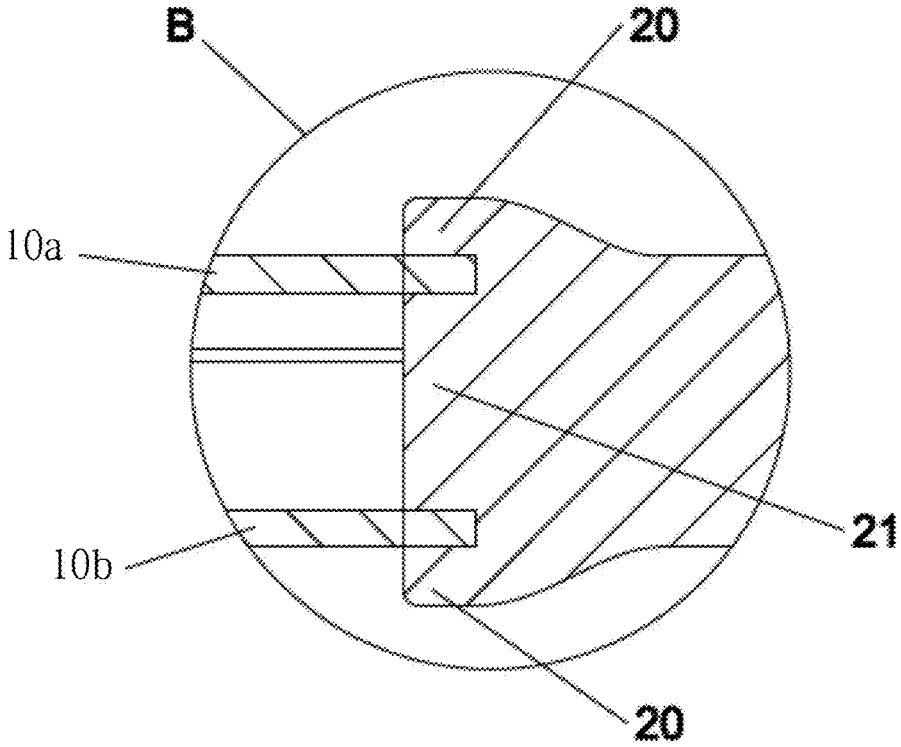
FIG. 10 is an enlarged diagram of a B portion of the zipper structure shown in FIG. 9 according to the first embodiment of the present invention.
Figure 11:
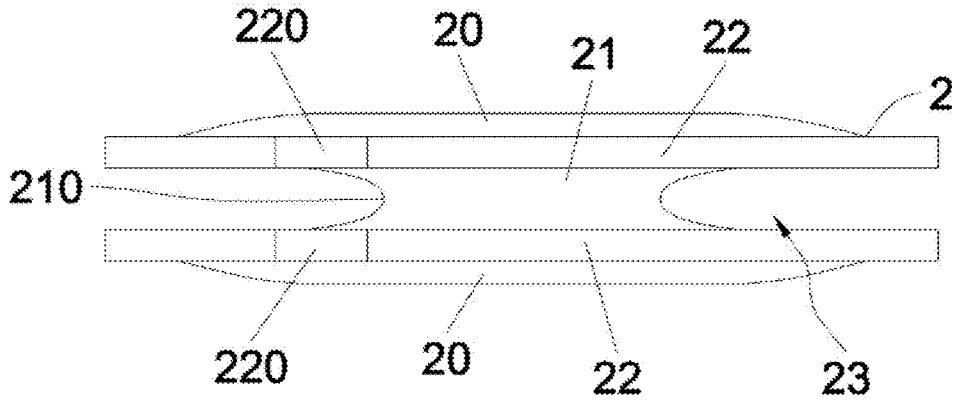
FIG. 11 is a lateral view diagram of the zipper structure according to the first embodiment of the present invention.

Please refer to FIG. 5 to FIG. 11. FIG. 5 to FIG. 8 are diagrams of a zipper structure 1 at different views according to a first embodiment of the present invention. FIG. 9 is a sectional diagram of the zipper structure 1 along an A-A line shown in FIG. 6 according to the first embodiment of the present invention. FIG. 10 is an enlarged diagram of a B portion of the zipper structure 1 shown in FIG. 9 according to the first embodiment of the present invention. FIG. 11 is a lateral view diagram of the zipper structure 1 according to the first embodiment of the present invention. As shown in FIGS. 5 to 11, the zipper structure 1 includes a first zipper component 10*a* and a second zipper component 10*b*. The first zipper component 10*a* includes a first zipper portion 100*a*. The second zipper component 10*b* includes a second zipper portion 100*b*. The first zipper portion 100*a* and the second zipper portion 100*b* have matched shapes for being detachably engaged with or separated from each other, so as to achieve an opening of a bag body to be open or closed.

In this embodiment, the first zipper component 10*a* and the second zipper component 10*b* can be identical. As shown in FIG. 8, the first zipper portion 100*a* can include two first protruding ribs 101*a* and a first recess structure 102*a* formed between the two first protruding ribs 101*a*, and the second zipper portion 100*b* include two second protruding ribs 101*b* and a second recess structure 102*b* formed between the two second protruding ribs 101*b*. When the first zipper portion 100*a* and the second zipper portion 100*b* are engaged with each other, one of the first protruding ribs 101*a* and one of the second protruding ribs 101*b* are respectively inserted into the second recess structure 102*b* and the first recess structure 102*a* for sealing the bag body. Furthermore, the first zipper component 10*a* and the second zipper component 10*b* can be misaligned from each other along a width direction W.

Figure 14:
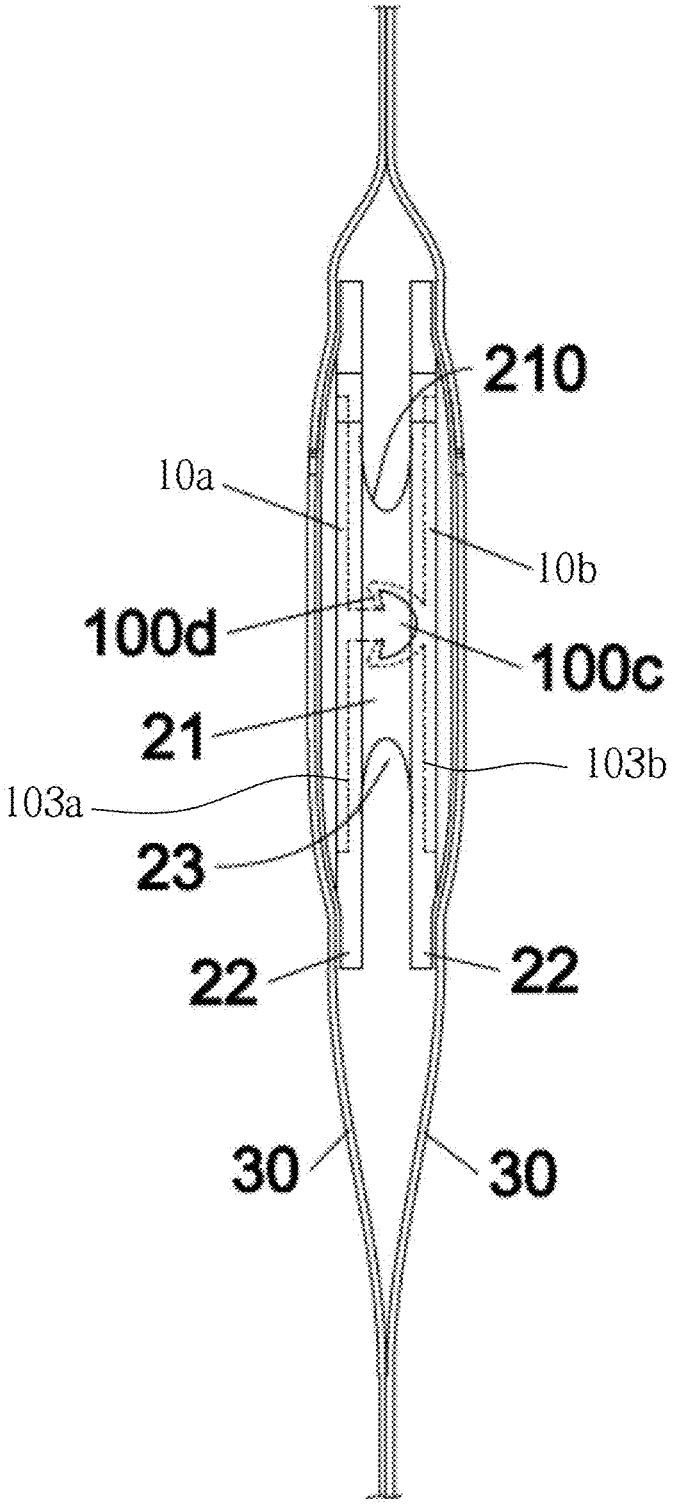
FIG. 14 is a lateral view diagram of the zipper bag according to the second embodiment of the present invention.

However, the present invention is not limited to this embodiment. The shapes of the first zipper portion 100*a* and the second zipper portion 100*b* can be other shapes and different from each other. For example, please refer to FIG. 14. FIG. 14 is a lateral view diagram of a zipper bag according to a second embodiment of the present invention. As shown in FIG. 14, in this embodiment, the first zipper component 10*a* includes an elongated engaging protrusion 100*c*, and the second zipper component 10*b* includes an elongated engaging notch structure 100*d*. The elongated engaging notch structure 100*d* and the elongated engaging protrusion 100*c* have matched shapes for being detachably engaged with or separated from each other, i.e., the elongated engaging protrusion 100*c* is engaged within the elongated engaging notch structure 100*d*. In this embodiment, the first zipper component 10*a* and the second zipper component 10*b* can be aligned with each other.

Besides, as shown in FIG. 5 to FIG. 11, the zipper structure 1 further includes two sealing end assemblies 2. The sealing end assembly 2 is connected to an end of the first zipper component 10*a* and an end of the second zipper component 10*b*. An end part of the first zipper portion 100*a* of the first zipper component 10*a* adjacent to the end of the first zipper component 10*a* and an end part of the second zipper portion 100*b* of the second zipper component 10*b* adjacent to the end of the second zipper component 10*b* are engaged with each other and fixedly connected to each other by the sealing end assembly 2. A middle part of the first zipper portion 100*a* of the first zipper component 10*a* and a middle part of the second zipper portion 100*b* of the second zipper component 10*b* can be engaged with or separated from each other to close or open the opening of the bag body.

The sealing end assembly 2 is a plastic product attached onto the first zipper component 10*a* and the second zipper component 10*b* and can be made of plastic material which can be connected to the first zipper component 10*a* and the second zipper component 10*b* by injection molding. In other words, the sealing end assembly 2 is not connected to the first zipper component 10*a* and the second zipper component 10*b* by plastic welding.

The sealing end assembly 2 includes two covering portions 20 and a connecting portion 21. The two covering portions 20 respectively cover at least a surface of the end of the first zipper component 10*a* and a surface of the end of the second zipper component 10*b*. Preferably, each covering portion 20 can cover an upper surface, a lower surface and an end surface of the end of the first zipper component 10*a* and an upper surface, a lower surface and an end surface of the end of the second zipper component 10*b*.

The connecting portion 21 is located between and connected to the two covering portions 20. During injection molding of the sealing end assembly 2, an injection material can enter into a gap i between the end part of the first zipper portion 100*a* of the first zipper component 10*a* adjacent to the end of the first zipper component 10*a* and the end part of the second zipper portion 100*b* of the second zipper component 10*b* adjacent to the end of the second zipper component 10*b*, so as to form the connecting portion 21. In other words, the gap i between the end part of the first zipper portion 100*a* of the first zipper component 10*a* adjacent to the end of the first zipper component 10*a* and the end part of the second zipper portion 100*b* of the second zipper component 10*b* adjacent to the end of the second zipper component 10*b* is filled with the connecting portion 21.

Besides, during injection molding of the sealing end assembly 2, the injection material also can enter a gap I between an end part of a first wing portion 103*a* of the first zipper component 10*a* adjacent to the end of the first zipper component 10*a* and an end part of a second wing portion 103*b* of the second zipper component 10*b* adjacent to the end of the second zipper component 10*b*, so that the gap I between the end part of the first wing portion 103*a* of the first zipper component 10*a* adjacent to the end of the first zipper component 10*a* and the end part of the second wing portion 103*b* of the second zipper component 10*b* adjacent to the end of the second zipper component 10*b* is filled with the connecting portion 21.

In order to allow the sealing end assembly 2 and the bag body to be well-connected to each other, the sealing end assembly 2 further includes two bridge portions 22 respectively outwardly extending from the two covering portions 20 and away from the end of the first zipper component 10*a* and the end of the second zipper component 10*b*. The two bridge portions 22 are configured to be connected to two plate-shaped components of the bag body by plastic welding. Specifically, as shown in FIG. 7 and FIG. 9, the two bridge portions 22 respectively extend along a plane where the first zipper component 10*a* is located and a plane where the second zipper component 10*b* is located and are parallel to each other. Preferably, as shown in FIG. 6, two ends of each of the two bridge portions 22 along a width direction W can respectively protrude beyond two extending lines E1, E2 of two sides of the first zipper component 10*a* along the width direction W and two extending lines E3, E4 of two sides of the second zipper component 10*b* along the width direction W, so as to increase a connecting area of each bridge portion 22 and the bag body for improving connecting strength.

Figure 1:
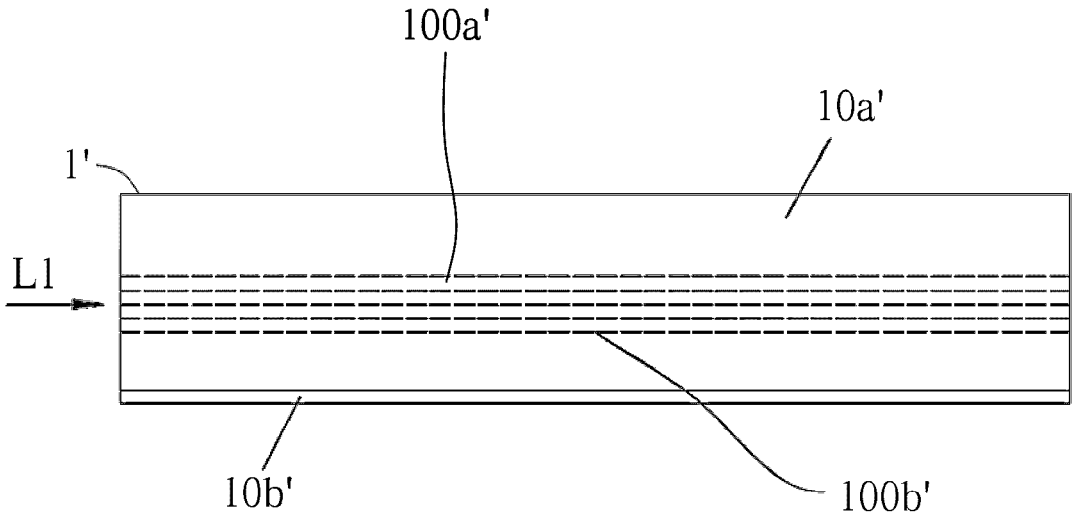
FIG. 1 PRIOR ART
FIG. 1 is a diagram of a zipper structure in the prior art.
Figure 2:
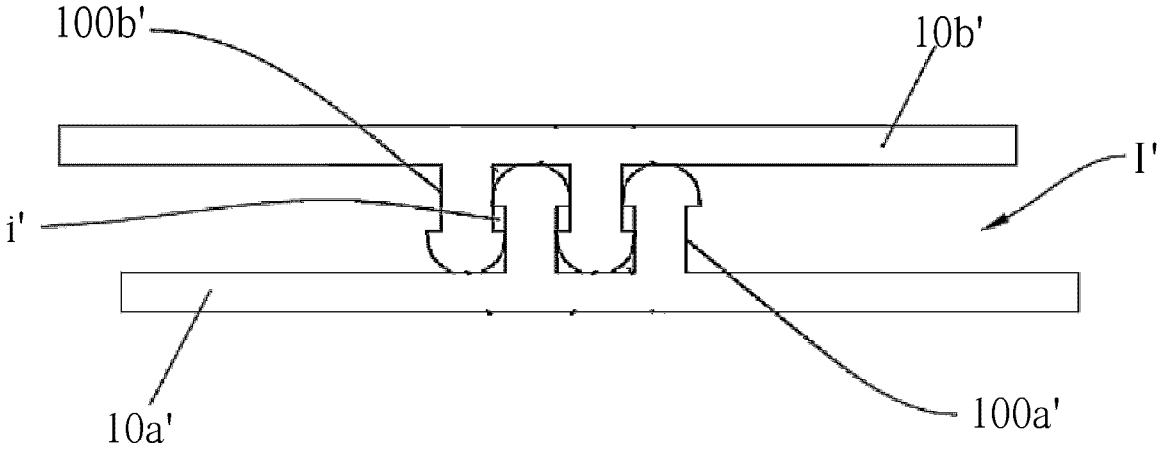
FIG. 2 PRIOR ART
FIG. 2 is a lateral view diagram of the zipper structure from a viewing direction in the prior art.
Figure 3:
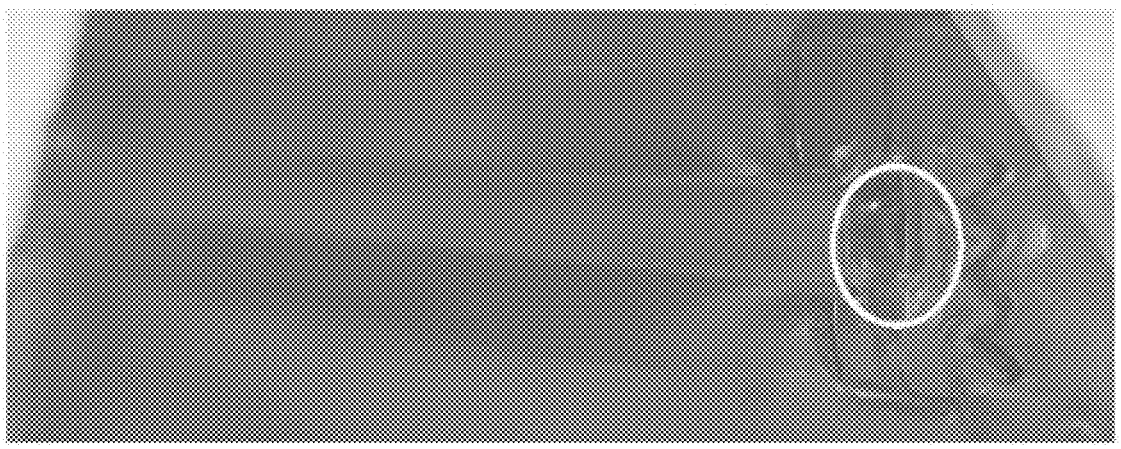
FIG. 3 is a grayscale photograph illustrating a welding portion of a bag body and an end of a zipper structure of a zipper bag in the prior art.
Figure 4:
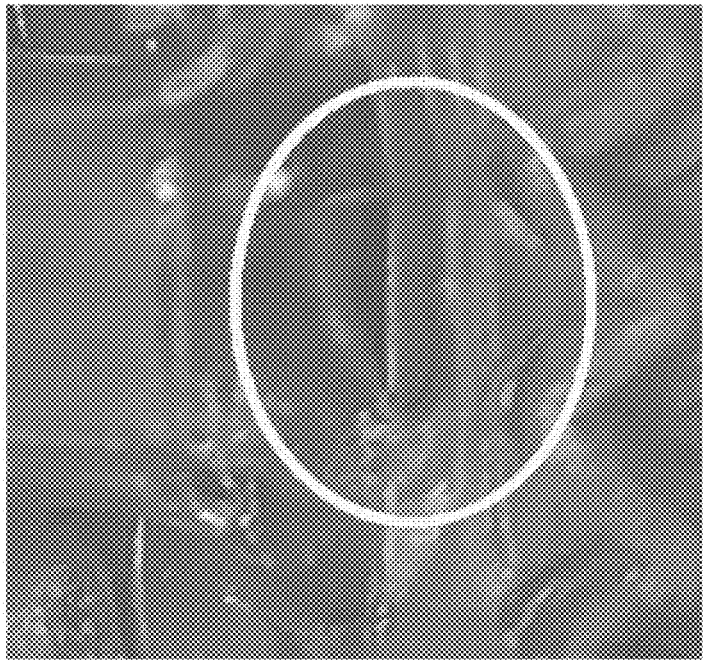
FIG. 4 is an enlarged grayscale photograph of the welding portion shown in FIG. 3 in the prior art.
Figure 5:
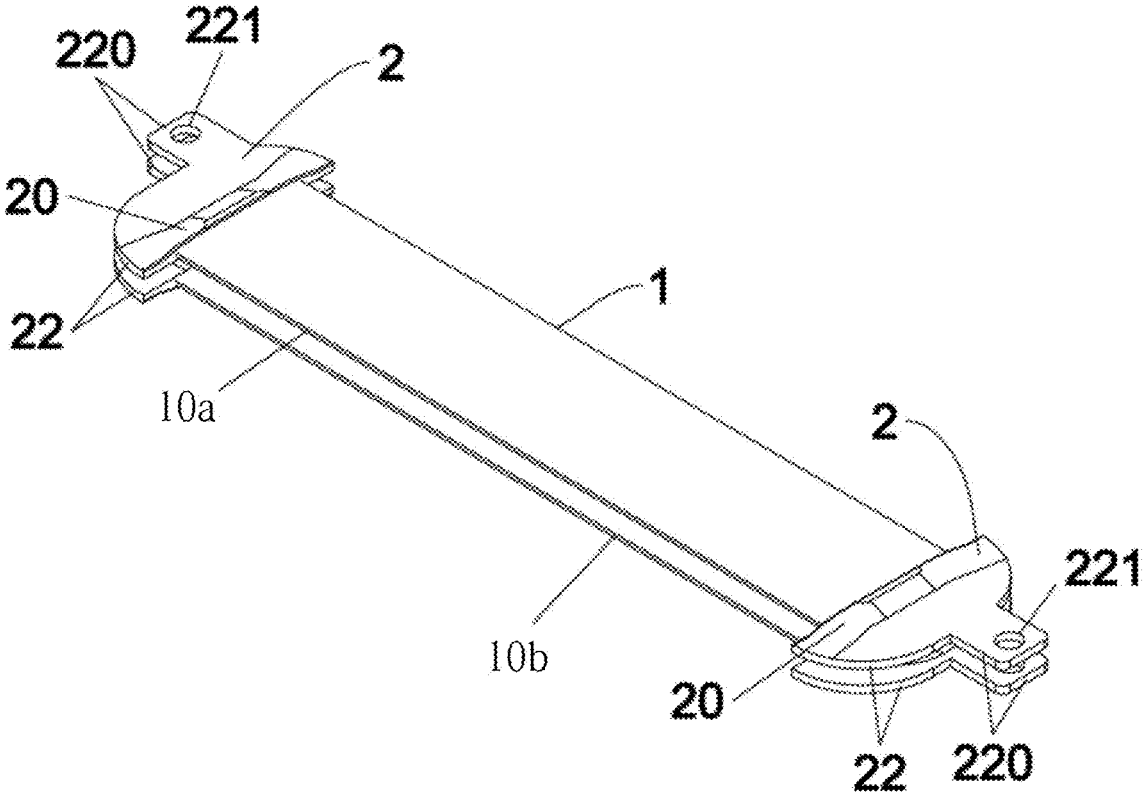
FIG. 5 to FIG. 8 are diagrams of a zipper structure at different views according to a first embodiment of the present invention.
Figure 6:
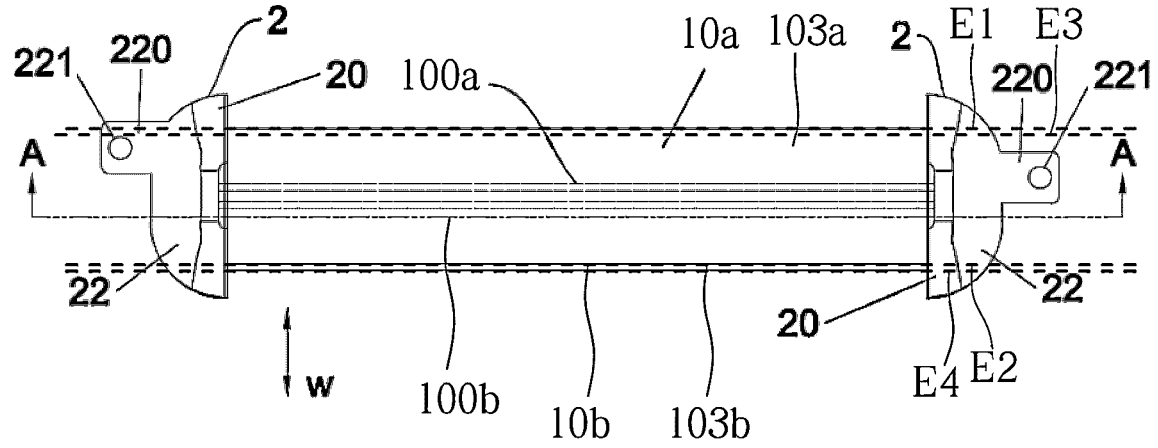

In this embodiment, as shown in FIG. 5 and FIG. 6, an outer periphery of the bridge portion 22 can be formed in an arc shape. However, the present invention is not limited to this embodiment. For example, in another embodiment, the outer periphery of the bridge portion 22 can be formed in any other shape.

In addition, as shown in FIG. 7, FIG. 9 and FIG. 11, in order to reduce a level difference formed by the two bridge portions 22, an outer surface 210 of the connecting portion 21 can be configured to be a concave surface and smoothly connected to two surfaces of the two bridge portions 22 facing toward each other, so as to provide a smooth transition between the two bridge portions 22. The outer surface 210 of the connecting portion 21, i.e., the concave surface, and the two surfaces of the two bridge portions 22 facing toward each other cooperatively form a concave space 23. When the sealing end assembly 2 is connected to the bag body by plastic welding, the two bridge portions 22 can be moved close to and attached to each other, so as to collapse the concave space 23. This configuration can effectively reduce the level difference formed by the two bridge portions 22, so as to prevent a damage of the bag body caused by an excessive level difference.

Furthermore, in order to position the sealing end assembly 2 when the sealing end assembly 2 is connected to the bag body by plastic welding, a positioning hole 221 is formed on each bridge portion 22. The two positioning holes 221 of the two bridge portions 22 are aligned with each other along a direction perpendicular to a plane where the zipper structure 1 is located. As shown in FIG. 5 and FIG. 6, the sealing end assembly 2 can further include a positioning plate 220 disposed on the outer periphery of each bridge portion 22 and extending outwardly, and each positioning hole 221 can be formed on the corresponding positioning plate 220. However, the present invention is not limited to this embodiment. For example, in another embodiment, the positioning hole can be formed on the corresponding bridge portion 22 directly.

Figure 12:
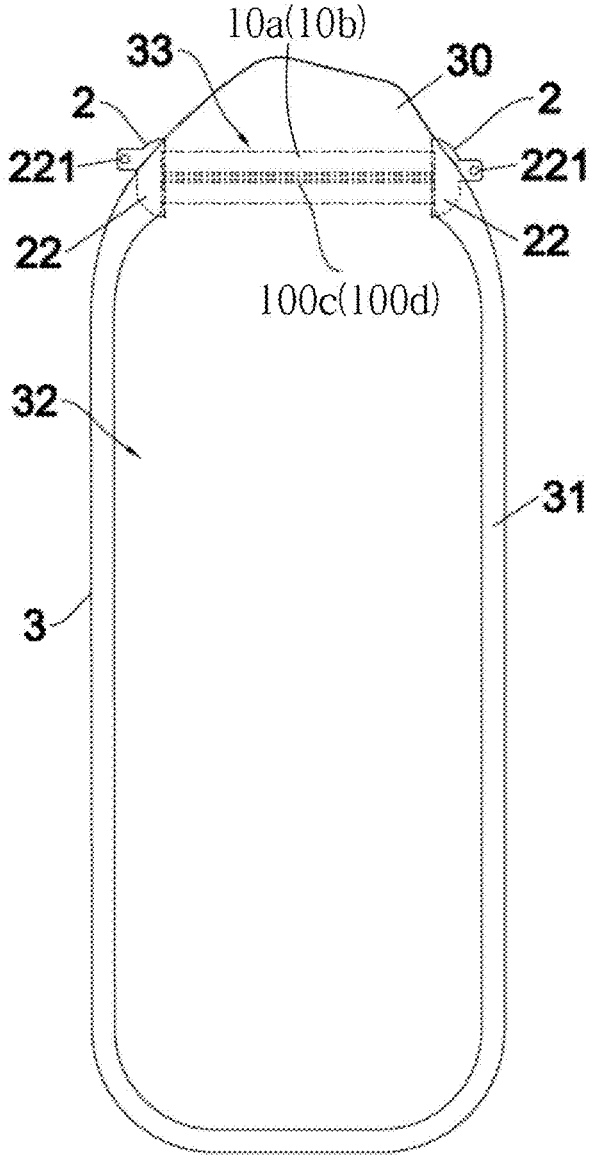
FIG. 12 and FIG. 13 are diagrams of a zipper bag at different views according to a second embodiment of the present invention.
Figure 13:
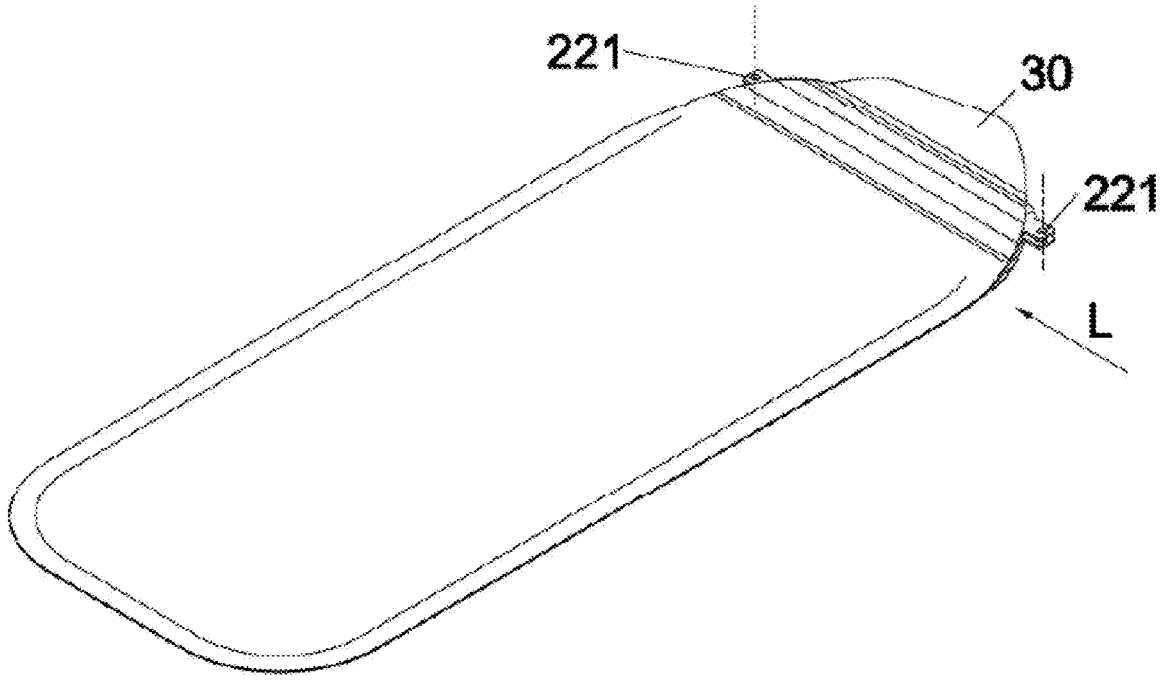
Figure 15:
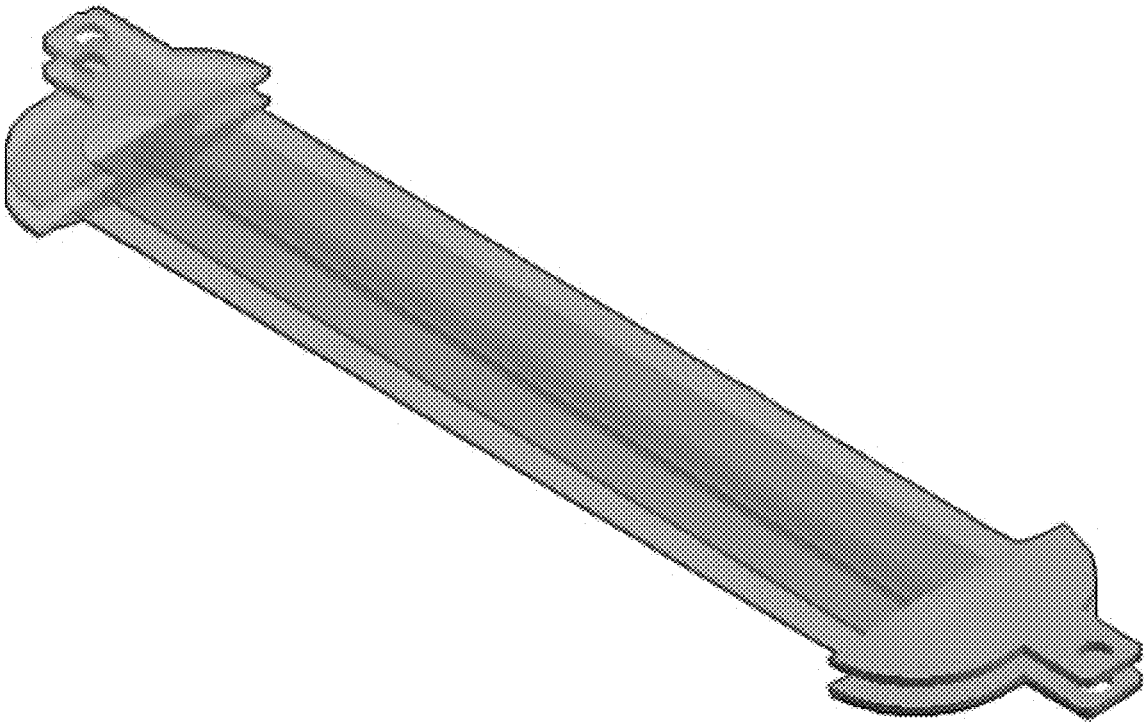
FIG. 15 is a grayscale diagram of a zipper structure according to the second embodiment of the present invention.
Figure 16:
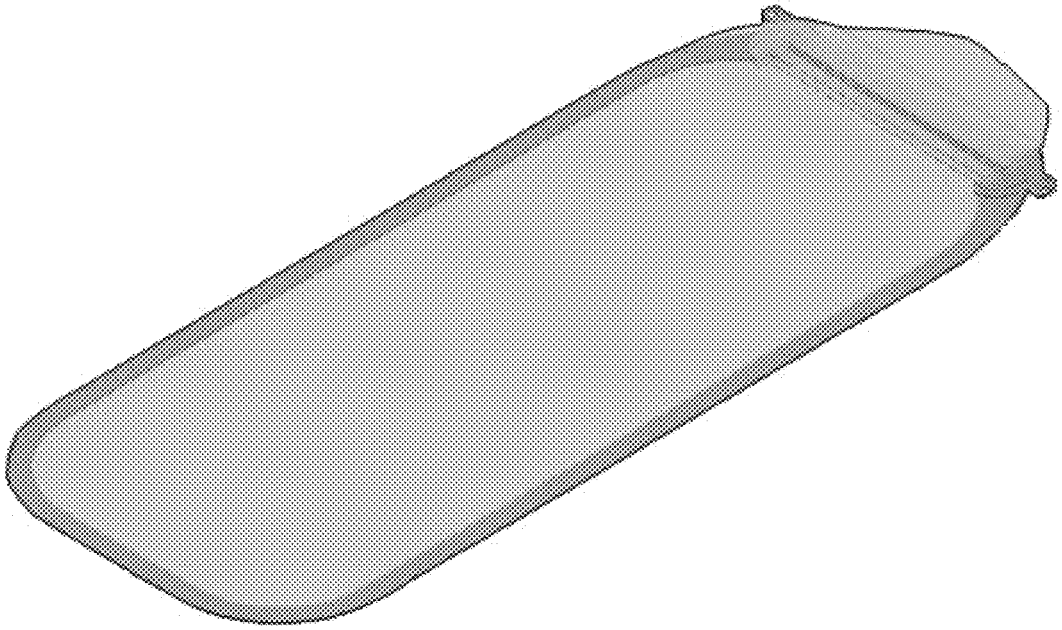
FIG. 16 is a grayscale diagram of the zipper bag according to the second embodiment of the present invention.
Figure 17:
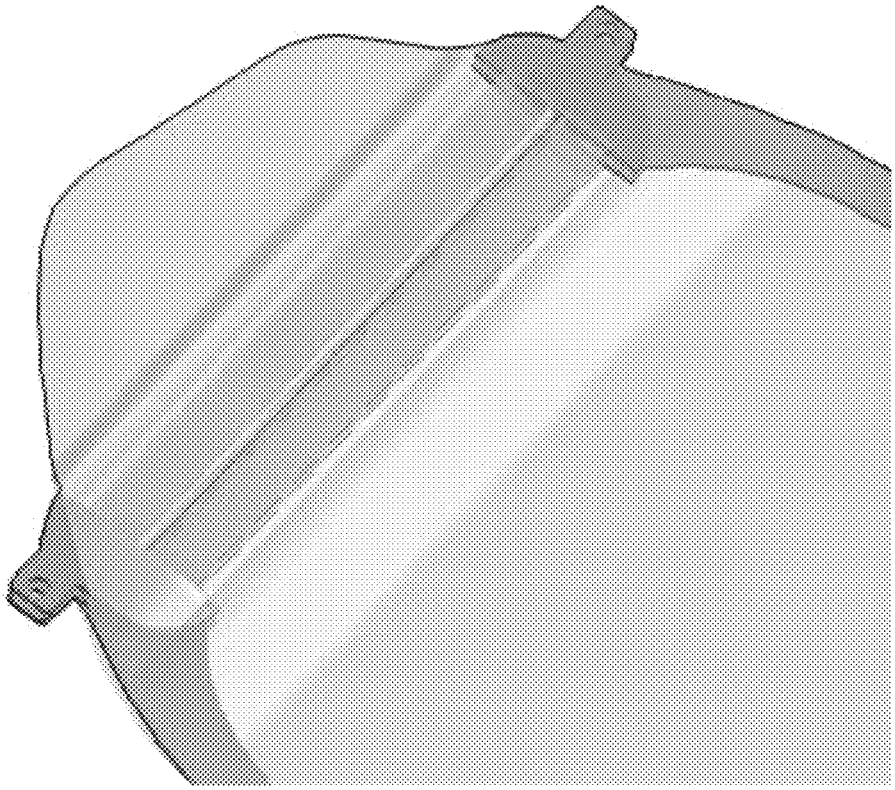
FIG. 17 is an enlarged grayscale diagram of the zipper bag according to the second embodiment of the present invention.

Please further refer to FIG. 12 to FIG. 17. FIG. 12 and FIG. 13 are diagrams of a zipper bag at different views according to the second embodiment of the present invention. FIG. 15 is a grayscale diagram of the zipper structure 1 according to the second embodiment of the present invention. FIG. 16 is a grayscale diagram of the zipper bag according to the second embodiment of the present invention. FIG. 17 is an enlarged grayscale diagram of the zipper bag according to the second embodiment of the present invention. As shown in FIG. 12 to FIG. 17, the zipper bag includes a bag body 3 and the zipper structure 1. The bag body 3 includes two plate-shaped components 30 connected to each other by plastic welding and is formed with a chamber 32 and an opening 33. Specifically, the two plate-shaped components 30 are connected to each other by at least one welding line 31. The opening 33 is communicated with the chamber 32 and an external environment. The structure of the bag body 3, the shapes and the dimensions of the plate-shape component and the numbers and the configurations of the opening 33 and the welding line 31 are not limited to those illustrated in the figures of this embodiment.

As shown in FIG. 12, the zipper structure 1 is located at a position corresponding to the opening 33 and located between the two plate-shaped components 30. The first zipper portion 100*c* of the first zipper component 10*a* and the second zipper portion 100*d* of the second zipper component 10*b* can be engaged with or separated from each other, so as to close or open the opening 33.

The sealing end assembly 2 is connected to the end of the first zipper component 10*a* and the end of the second zipper component 10*b* by injection molding, and then the first zipper component 10*a*, the second zipper component 10*b* and the sealing end assembly 2 are connected to the bag body 3 by plastic welding.

When the sealing end assembly 2 is connected to the end of the first zipper component 10*a* and the end of the second zipper component 10*b* by injection molding, the two covering portions 20 and the connecting portion 21 can be formed. The two covering portions 20 respectively cover the surface of the end of the first zipper component 10*a* and the surface of the end of the second zipper component 10*b*. The connecting portion 21 is located between and connected to the two covering portions 20. The gap i between the end part of the first zipper portion 100*c* of the first zipper component 10*a* adjacent to the end of the first zipper component 10*a* and the end part of the second zipper portion 100*d* of the second zipper component 10*b* adjacent to the end of the second zipper component 10*b* is filled with the connecting portion 21, and the gap I between the end part of the first wing portion 103*a* of the first zipper component 10*a* adjacent to the end of the first zipper component 10*a* and the end part of the second wing portion 103*b* of the second zipper component 10*b* adjacent to the end of the second zipper component 10*b* is also filled with the connecting portion 21.

Besides, when the sealing end assembly 2 is connected to the end of the first zipper component 10*a* and the end of the second zipper component 10*b* by injection molding, the two bridge portions 22 can be formed. The two bridge portions 22 respectively outwardly extend from the two covering portions 20 and away from the end of the first zipper component 10*a* and the end of the second zipper component

10*b*. Specifically, the two bridge portions 22 respectively extend along the plane where the first zipper component 10*a* is located and the plane where the second zipper component 10*b* is located and are parallel to each other. Preferably, as shown in FIG. 6, the two ends of each of the two bridge portions 22 along the width direction W can respectively protrude beyond the two extending lines E1, E2 of two sides of the first zipper component 10*a* along the width direction W and the two extending lines E3, E4 of the two sides of the second zipper component 10*b* along the width direction W. As mentioned above, the two positioning holes 221 can be formed on the two positioning plates 201 or the two bridge portions 22 and aligned with each other along the direction perpendicular to the plane where the zipper structure 1 is located, so as to facilitate positioning of the sealing end assembly 2. And more preferably, as shown in FIG. 14, the outer surface 201 of the connecting portion 21 can be configured to be the concave surface and smoothly connected to two surfaces of the two bridge portions 22 facing toward each other, so as to reduce the level difference formed by the two bridge portions 22.

After the sealing end assembly 2 is connected to the end of the first zipper component 10*a* and the end of the second zipper component 10*b* by injection molding, the two plate-shaped components 30 are respectively connected to the first zipper component 10*a* and the second zipper component 10*b* by plastic welding and are connected to each other and the sealing end assembly 2 by plastic welding. As shown in FIG. 12 and FIG. 13, the two plate-shaped components 30 can be connected to each other and connected to the sealing end assembly 2 by the same welding line 31.

Specifically, when the sealing end assembly 2 is connected to the bag body 3 by plastic welding, the covering portions 20 are connected to inner sides of the two plate-shaped components 30, and the bridge portions 22 are connected to the inner sides of the two plate-shaped components 30. Furthermore, when the sealing end assembly 2 is connected to the bag body 3 by plastic welding, the bridge portions 22 can be moved close to and connected to each other to collapse the concave space 23 for reducing the level difference formed by the two bridge portions 22.

The bag body 3, of the first zipper component 10*a*, the second zipper component 10*b* and the sealing end assembly 2 can be connected each other by plastic welding. Specifically, the material of the first zipper component 10*a*, the material of the second zipper component 10*b* and the material of the sealing end assembly 2 can be Polyurethane (PU), Thermoplastic Polyurethane (TPU), Polyvinyl chloride (PVC), Acrylonitrile Butadiene Styrene (ABS) or other plastic materials. Preferably, in order to improve the connecting strength, the material of the bag body 3, the material of the first zipper component 10*a*, the material of the second zipper component 10*b* and the material of the sealing end assembly 2 can be identical. However, the present invention is not limited to this embodiment. In another embodiment, the material of the bag body 3, the material of the first zipper component 10*a*, the material of the second zipper component 10*b* and the material of the sealing end assembly 2 can be different.

Moreover, plastic welding can be laser plastic welding, high frequency plastic welding, ultrasonic plastic welding, or any other plastic welding technology.

The shape and the dimension of the sealing end assembly 2 can be determined according to the shapes and the dimensions of the bag body 3, the first zipper component 10*a* and the second zipper component 10*b*.

In contrast to the prior art, in the present invention, the sealing end assembly is connected to the end of the first zipper component and the end of the second zipper component by injection molding, so that the surface of the end of the first zipper component and the surface of the end of the second zipper component can be covered by the sealing end assembly, and the gap between the end part of the first zipper portion of the first zipper component adjacent to the end of the first zipper component and the end part of the second zipper portion of the second zipper component adjacent to the end of the second zipper component can be filled with the sealing end assembly. Therefore, the present invention has improved sealing performance.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A zipper structure comprising:

a first zipper component comprising a first zipper portion;

a second zipper component comprising a second zipper portion, the first zipper portion and the second zipper portion having matched shapes for being detachably engaged with or separated from each other, an end part of the first zipper portion of the first zipper component adjacent to an end of the first zipper component and an end part of the second zipper portion of the second zipper component adjacent to an end of the second zipper component being engaged with each other; and a sealing end assembly connected to the end of the first zipper component and the end of the second zipper component by injection molding, the sealing end assembly comprising:

two covering portions respectively covering a surface of the end of the first zipper component and a surface of the end of the second zipper component; and a connecting portion located between and connected to the two covering portions, a gap between the end part of the first zipper portion of the first zipper component adjacent to the end of the first zipper component and the end part of the second zipper portion of the second zipper component adjacent to the end of the second zipper component being filled with the connecting portion;

wherein when the sealing end assembly is connected to the end of the first zipper component and the end of the second zipper component by injection molding, two surfaces of the sealing end assembly are respectively connected to inner sides of two plate-shaped components of a bag body by plastic welding.

2. The zipper structure of claim 1, wherein the sealing end assembly further comprises two bridge portions respectively outwardly extending from the two covering portions and away from the end of the first zipper component and the end of the second zipper component.

3. The zipper structure of claim 2, wherein two ends of each of the two bridge portions along a width direction respectively protrude beyond two extending lines of two sides of each of the first zipper component and the second zipper component along the width direction.

4. The zipper structure of claim 2, wherein an outer surface of the connecting portion is a concave surface and smoothly connected to two surfaces of the two bridge portions facing toward each other.

5. The zipper structure of claim 4, wherein two ends of each of the two bridge portions along a width direction respectively protrude beyond two extending lines of two sides of each of the first zipper component and the second zipper component along the width direction.

6. The zipper structure of claim 2, wherein the two bridge portions respectively extend along a plane where the first zipper component is located and a plane where the second zipper component is located.

7. The zipper structure of claim 6, wherein two ends of each of the two bridge portions along a width direction respectively protrude beyond two extending lines of two sides of each of the first zipper component and the second zipper component along the width direction.

8. A zipper bag comprising:

a bag body comprising two plate-shaped components connected to each other by plastic welding, the bag body being formed with a chamber and an opening communicated with the chamber; and a zipper structure disposed on the bag body and located at a position corresponding to the opening, the zippering structure being located between the two plate-shaped components and comprising:

a first zipper component comprising a first zipper portion and connected to an inner side of one of the two plate-shaped components by plastic welding;

a second zipper component comprising a second zipper portion and connected to an inner side of another one of the two plate-shaped components by plastic welding, the first zipper portion and the second zipper portion having matched shapes for being detachably engaged with or separated from each other, an end part of the first zipper portion of the first zipper component adjacent to an end of the first zipper component and an end part of the second zipper portion of the second zipper component adjacent to an end of the second zipper component being engaged with each other; and an sealing end assembly connected to the end of the first zipper component and the end of the second zipper component by injection molding and located between the two plate-shaped components, the sealing end assembly covering a surface of the end of the first zipper component and a surface of the end of the second zipper component, a gap between the end part of the first zipper portion of the first zipper component adjacent to the end of the first zipper component and the end part of the second zipper portion of the second zipper component adjacent to the end of the second zipper component being filled with the sealing end assembly;

wherein when the sealing end assembly is connected to the end of the first zipper component and the end of the second zipper component by injection molding, two surfaces of the sealing end assembly are respectively connected to the inner sides of the two plate-shaped components by plastic welding, and after the sealing end assembly is connected to the end of the first zipper component and the end of the second zipper component by injection molding, the two plate-shaped components are respectively connected to the first zipper component and the second zipper component and are connected to each other and the sealing end assembly by plastic welding.

9. The zipper bag of claim 8, wherein a material of the bag body, a material of the first zipper component, a material of the second zipper component and a material of the sealing end assembly are identical.

10. The zipper bag of claim 8, wherein when the sealing end assembly is connected to the end of the first zipper component and the end of the second zipper component by injection molding, the sealing end assembly comprises two covering portions, a connecting portion and two bridge portions, the two covering portions respectively cover the surface of the end of the first zipper component and the surface of the end of the second zipper component, the connecting portion is located between and connected to the two covering portions, the gap between the end part of the first zipper portion of the first zipper component adjacent to the end of the first zipper component and the end part of the second zipper portion of the second zipper component adjacent to the end of the second zipper component is filled with the connecting portion, the two bridge portions respectively outwardly extend from the two covering portions and away from the end of the first zipper component and the end of the second zipper component.

11. The zipper bag of claim 10, wherein a material of the bag body, a material of the first zipper component, a material of the second zipper component and a material of the sealing end assembly are identical.

12. The zipper bag of claim 10, wherein when the sealing end assembly is connected to the end of the first zipper component and the end of the second zipper component by injection molding, and an outer surface of the connecting portion is a concave surface and smoothly connected to two surfaces of the two bridge portions facing toward each other.

13. The zipper bag of claim 12, wherein a material of the bag body, a material of the first zipper component, a material of the second zipper component and a material of the sealing end assembly are identical.

14. The zipper bag of claim 10, wherein two ends of each of the two bridge portions along a width direction respectively protrude beyond two extending lines of two sides of each of the first zipper component and the second zipper component along the width direction.

15. The zipper bag of claim 14, wherein a material of the bag body, a material of the first zipper component, a material of the second zipper component and a material of the sealing end assembly are identical.

* * * * *